United States Patent [19]

Marmin

[11] Patent Number: 4,862,801

[45] Date of Patent: Sep. 5, 1989

[54] DEVICE FOR HOLDING A PRINTING PLATE ONTO A PLATE CYLINDER IN A ROTARY OFFSET PRINTING PRESS

[75] Inventor: Jean-Claude Marmin, Estrees St-Denis, France

[73] Assignee: Harris-Marinoni S.A., Montataire, France

[21] Appl. No.: 164,587

[22] Filed: Mar. 7, 1988

[30] Foreign Application Priority Data

Mar. 10, 1987 [FR] France ..... 87 03242

[51] Int. Cl.[4] ..... B41F 27/00; B41F 27/12

[52] U.S. Cl. ..... 101/415.1

[58] Field of Search ..... 101/407 A, 409, 415.1

[56] References Cited

U.S. PATENT DOCUMENTS

| | | | |
|---|---|---|---|
| 2,822,754 | 2/1958 | Huck | 101/415.1 |
| 3,727,551 | 4/1973 | Kostas et al. | 101/415.1 |
| 4,527,478 | 7/1985 | Difflipp et al. . | |

FOREIGN PATENT DOCUMENTS

| | | | |
|---|---|---|---|
| 2441367 | 8/1974 | Fed. Rep. of Germany | 101/415.1 |
| 2146887 | 2/1973 | France . | |
| 1321028 | 6/1973 | United Kingdom . | |

OTHER PUBLICATIONS

Description of the Principle of a Toggle Plate Lock-Up Used by Harris USA , dated Feb. 8, 1988.

*Primary Examiner*—Edgar S. Burr
*Assistant Examiner*—James Lisehora
*Attorney, Agent, or Firm*—Tarolli, Sundheim & Covell

[57] ABSTRACT

A device for holding a printing plate onto a plate cylinder in a rotary offset printing press, which comprises a bar for tensioning the plate and a control mechanism for this bar which comprises a crank coupled to the tensioning bar; a rigid link articulated to the crank, provided with engagement means for a maneuvering member; and a spring link articulated to the rigid link and the plate cylinder.

10 Claims, 3 Drawing Sheets

DEVICE FOR HOLDING A PRINTING PLATE ONTO A PLATE CYLINDER IN A ROTARY OFFSET PRINTING PRESS

The invention concerns a device for holding a printing plate onto a plate cylinder in a rotary offset printing press.

As is known, in the offset printing process the printing medium is removable; it is a thin (0.2–0.6 mm) plate generally of metal ( aluminium, bronze or steel), often an aluminium plate 0.3–0.4 mm thick.

This plate receives the printing form in the flat state in a frame where it is printed photographically by exposure through a transparent film carrying the image to be reproduced, which defines corresponding print on the plate.

The plate then has to be fixed to a plate cylinder of the printing machine, in an extremely precise position relative to the image that it carries if printing in colour ( in which case there are four printing operations by successive cylinders, each corresponding to one basic colour).

This fixing is sometimes done by magnetic means (if the plate is steel-backed), pneumatic means (suction is applied through orifices in the cylinder), adhesive means (double-sided adhesive tape is placed between the cylinder and the plate) or mechanical means such as jaws, but these means are relatively rare, the device most often used comprising a plate tensioning bar which enables the plate to be tensioned when fitted and then holds it in place.

In a device of this kind the tensioning bar is usually operated by worm gear mechanisms disposed at each end of the bar, the worm wheel being constrained to rotate with the bar while the worm is operated by the user. The plate is initially fitted in an approximate way, after releasing the coupling between the bar and the worm gear mechanisms, then the coupling is remade and fitting is completed by operating the two worms simultaneously.

The use of these control mechanisms for the bar requires some skill because of the coupling release and re-engagement maneuvers and, most of all, because of the need once the coupling has been re-engaged to operate the worms situated to either side of the cylinder simultaneously.

The invention is intended in particular to alleviate these difficulties. To this end it proposes a device for holding the plate which comprises a tensioning bar for the plate and a control mechanism for this bar comprising a crank coupled to the tensioning bar; a rigid link articulated at one end to said crank, provided with engagement means for a maneuvering member; a spring link articulated at a first end to a second end of the rigid link and articulated at a second end to the plate cylinder; and a supporting abutment for the articulation device between the spring link and the rigid link, located so that the axis of this articulation is near a plane comprising the articulation axis of the spring link to the cylinder and the articulation axis of the rigid link to the crank when the latter is in a position for which the plate is tensioned on the cylinder; the sum of the unstressed length of the spring link and of the length of the rigid link being greater than the distance between these articulation axes in this plane.

To operate the mechanism, the rigid link is set in motion by means of the maneuvering member and turns about its articulation to the crank and at the same time about its articulation to the spring link. These articulations are both able to move, movement of the articulation with the crank corresponding to rotational movement of the tensioning bar whereas movement of the articulation with the spring link corresponds to rotation of the latter about its articulation to the cylinder, possibly accompanied by compression or extension of this link.

During a maneuver to mount the plate on the cylinder, the articulation with the crank is moved first, the crank turning with relatively little resistance since the printing plate is not yet tensioned on the cylinder. When the plate is tensioned it is virtually impossible for the tensioning bar to turn any further and the crank is in a virtually fixed position. As the movement of the rigid link continues, a second phase is entered where, using the crank to bear against, the spring link is compressed as it is turned about its articulation to the cylinder, until it reaches the supporting abutment for the articulation between the spring link and the rigid link, which defines the end of the movement for fitting the plate.

Of course, the abutment is placed beyond a point of maximum compression of the spring link so that the natural tendency of the latter to continue the expansion begun at the end of the movement forces it to bear against the abutment, so that the control mechanism for the bar is locked. To unlock it a movement in the reverse direction is required, that is to say it is necessary to recompress tha spring link by disengaging the articulation device from the abutment, to go beyond the point of maximum compression, and to bear on the articulation with the spring link when the latter is unstretched to be able to turn the crank and then release the plate.

The control mechanism in accordance with the invention is simple and convenient to use, it being only necessary to turn the rigid link with the maneuvering member to carry out the tensioning and then the locking in one and the same movement, the two phases of which follow on from each other automatically, without any coupling release or re-engagement being needed, unlike the prior art devices.

It is quite possible to use a mechanism having the characteristics as previously described at one end only of the tensioning bar, but the bar is generally held better in the locked position if a mechanism is provided at each end of the bar.

Under such conditions of use, the movement of the mechanisms is much easier than with the prior art mechanisms using worm gears since it is possible to operate successively at each end of the bar, there being no requirement for simultaneous operation.

Over a major part of its travel the maechanism functions in configurations where rotational movement of the bar is unrestricted; it is only when the plate is tensioned or in the locking position that any resistance to these movements is felt. When fitting the plate, it is sufficient to operate from a single end of the bar to stretch the plate; it is then merely necessary to lock the mechanism currently being operated by moving it as far as the abutment, and then to repeat the same operation on the mechanism at the other end. To release the plate one end is released and then the other, the manoeuvre continuing at this latter end to turn the bar to a position in which the plate can be removed.

Other characteristics, special features and advantages of the invention will emerge, together with those already described, in the course of the description of one embodiment of a device for holding an offset plate onto a cylinder given hereinafter by way of non-limiting example with reference to the appended drawings.

Figure 4:
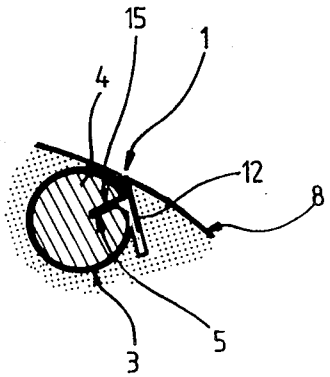
FIG. 4 is an enlargement of the portion of FIG. 3 showing the plate holding device.

The embodiment of a device for holding a printing plate onto a plate cylinder illustrated in the drawings is shown in a general way in FIGS. 1 through 4. This device comprises a slot 1 formed in the plate cylinder 2 along a generatrix thereof; a bore 3 formed under the lateral surface of the cylinder 2 near the slot 1, into which it opens; a cylindrical tensioning bar 4 housed in the bore 3 and comprising a slot 5 formed along a generatrix; bearing discs 6A and 6B for the blanket cylinder with which the cylinder 2 cooperates, situated one at each end of the latter; and control mechanisms 7A and 7B for the tensioning bar 4, disposed on the cylinder externally of the bearing discs, bores being formed in the latter for the tensioning bar to pass through.

Figure 1:
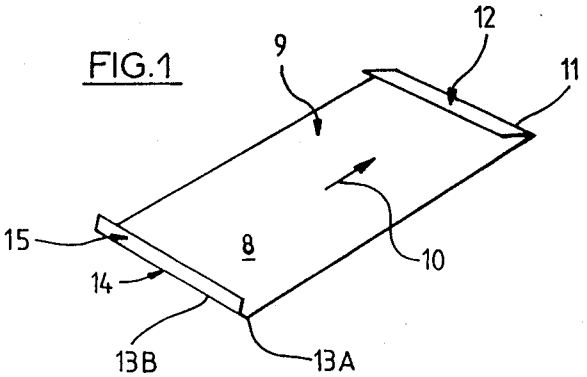
FIG. 1 is a perspective view of a printing plate designed to be held onto the plate cylinder shown in FIG. 2.
Figure 2:
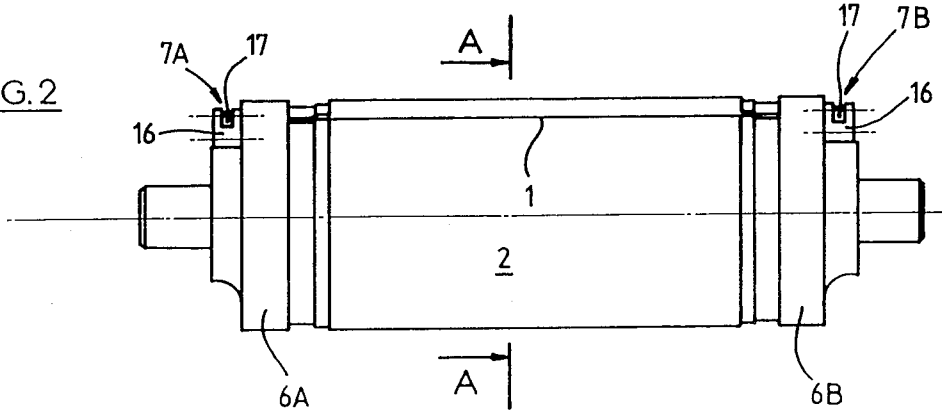
FIG. 2 is a view in lateral elevation of a plate cylinder provided with a device in accordance with the invention.

FIG. 1 shows a printing plate 8 in a position where the surface 9 intended to face the lateral surface of the cylinder 2 can be seen, the plate being designed to move in the direction shown by the arrow 10. For fitting it to the cylinder 2, the plate 8 has a fold 11 at the leading edge to delimit a leading marginal end portion 12 and two parallel folds 13A, 13B at the trailing edge to delimit an intermediate end portion 14 and a trailing marginal end portion 15.

Figure 3:
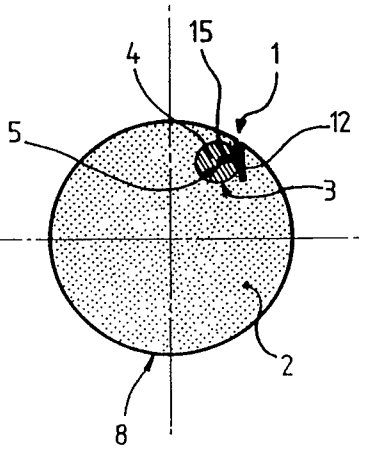
FIG. 3 is a view in cross-section on the line A—A in FIG. 2 showing the plate mounted on the cylinder.

As seen in FIGS. 3 and 4, the leading marginal end portion 12 is inserted into the slot 1 in the cylinder and the trailing marginal end portion 15 is inserted into the slot 5 in the tensioning bar, after the plate has been wound around the cylinder, between the bearing discs 6A and 6B, the plate 8 being tensioned by operating the control mechanisms 7A and 7B for the bar.

This manner of fixing the plate to the cylinder by a single fold at the leading edge and two parallel folds at the trailing edge, by means of which the tension is applied, relying on the resistance of these folds to unfolding, with corresponding slots on the cylinder and on the tensioning bar, is a well known solution to the problem of holding a printing plate onto a plate cylinder, using a plate tensioning bar.

This solution is advantageous because of its simplicity and the accurate positioning that it provides for, highly appreciated in the color printing art; it is therefore beneficial to use it.

It has to be noted, however, that the invention is not limited to this preferred solution but rather that it relates to any plate holding device which has a tensioning bar that has to be turned to tension the plate and then locked into position when the plate is tensioned, these devices being entirely suited to incorporating a tensioning bar control mechanism in accordance with the invention.

FIGS. 5 through 8 show the control mechanism 7A of the holding device with which the cylinder 2 is provided, the mechanism 7B at the other end being identical.

In accordance with the invention, this mechanism comprises a crank 16 coupled in rotation to the tensioning bar 4, a rigid link 17 articulated at a first end to the crank 16, provided with engagement means 18 for a maneuvering member 19; a spring link 20 articulated at a first end to a second end of the rigid link 17 and articulated at a second end to the plate cylinder 2, and a supporting abutment 21 for the articulation device between the spring link 20 and the rigid link 17, located so that the axis 52 of this articulation is near a plane containing the articulation axis 53 of the spring link 20 to the cylinder 2 and the articulation axis 54 of the rigid link 17 to the crank 16 when the latter is in a position in which the plate is tensioned on the cylinder; the sum of the unstressed length of the spring link 20 and the length of the rigid link 17 is greater than the distance between these articulation axes 53 and 54 in this plane.

Figures 5, 6, 7:
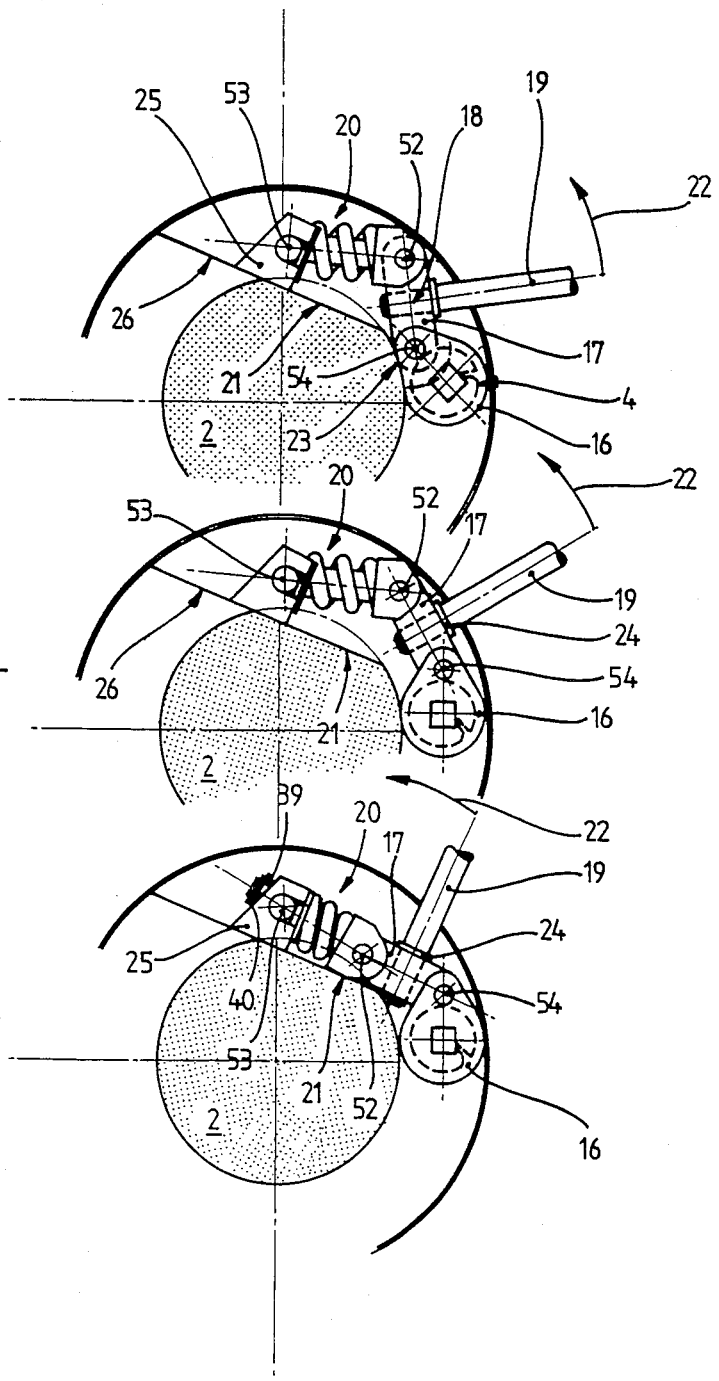
FIGS. 5 through 7 are partial lefthand end views of the plate cylinder shown in FIGS. 2 through 4, showing three successive positions of the tensioning bar control mechanisms.
Figure 8:
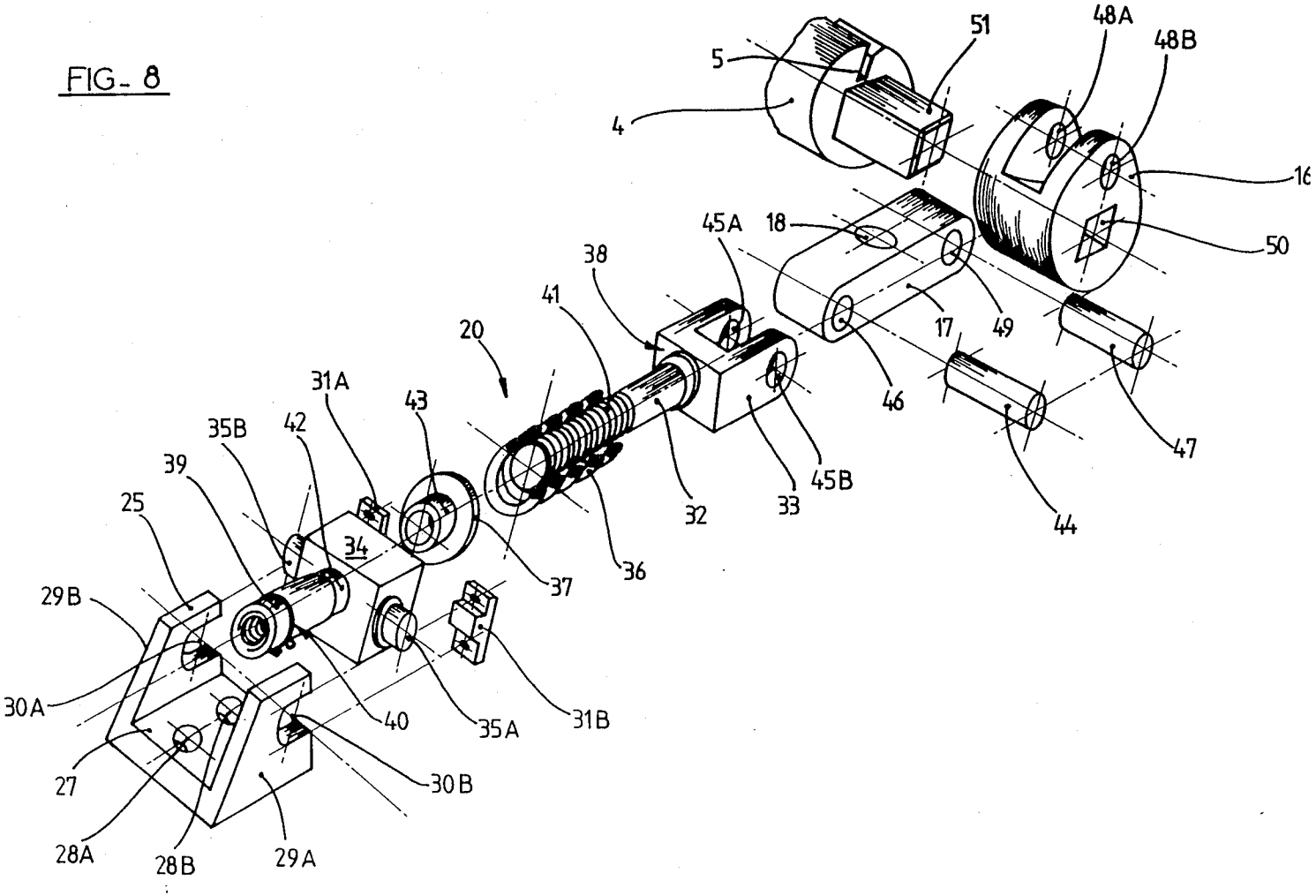
FIG. 8 is an exploded view of this mechanism.

The control mechanism is operated by turning the rigid link 17 using the maneuvering member 19, as seen in FIGS. 5 though 7.

In the position shown in FIG. 5, the slot 5 in the tensioning bar is in the position for inserting the trailing terminal end portion 15 of the plate (not shown in FIGS. 5 through 7) and the leading terminal end portion 12 is anchored into the slot 1 (not shown in FIGS. 5 through 7) of the cylinder 2.

The positions shown in FIGS. 6 and 7 are obtained by turning the maneuvering member 19 anticlockwise, as indicated by the arrow 22.

Between the positions corresponding to FIGS. 5 and 6 the plate 8 is not tensioned on the cylinder 2, and so the tensioning bar 4 can turn relatively easily, the articulation 54 between the rigid link 17 and the crank 16 therefore moving although the articulation 52 between the rigid link 17 and the spring link 20 remains relatively fixed in position, serving as a sort of bearing point for the movement that occurs between the positions shown in FIGS. 5 and 6. In this latter position the plate is almost tensioned on the cylinder 2, with the result that the tensioning bar turns against a greater resistance. When this resistance becomes greater than the force needed to compress the spring link, it is the articulation 52 which becomes mobile, the spring link turns about its articulation 53 to the cylinder, towards the abutment 21, becoming compressed as it does so, reaching a point of maximum compression when the three articulations 52 though 54 are coplanar; the articulation device between the spring link and the rigid link then comes to bear against the abutment 21 slightly beyond the point of maximum compression, with the result that the natural tendency of the spring link to expand forces this articulation against the abutment 21. The mechanism is then locked and the plate 8 is in the position relative to the cylinder 2 and the bar 4 shown in FIGS. 3 and 4.

It will be noted that the engagement means 18 are located near the slot 1 in the cylinder, which is highly beneficial since it is possible to maneuver this tensioning bar control device with the cylinder in the angular position for inserting the trailing edge and it is not necessary to rotate the cylinder out of this position to obtain access to the maneuvering means, as was the case with the prior art devices.

It will be noted that the angle through which the leading terminal end portion 12 is folded corresponds substantially to the angle between the lateral surface of the cylinder and the slot 1 and that the angles corresponding to the folds 13A and 13B and the size of the intermediate end portion 14 are chosen to enable the latter to enter easily into the slot 1 when the plate 8 is stretched by turning the tensioning bar 4 clockwise. A chamfer rounds off the edge between the slot 5 and the lateral surface of the tensioning bar 4, to facilitate insertion of the terminal end portion 15 into this slot.

The mechanism 7A is sufficient for holding the bar 4 in the locked position, but in this embodiment the mechanism 7B is preferably provided at the other end of the bar, to hold it better.

When the plate 8 is tensioned on the cylinder 2 by operating the mechanism 7A ( to obtain the movement between the positions shown in FIGS. 5 and 6), the mechanism 7B is subject to the same movement and then remains substantially in the configuration shown in FIG. 6 while the mechanism 7A is locked. Once this locking has been done, the maneuvering member 19 is taken out and then inserted into the rigid link of the mechanism 7B, to lock the latter in its turn. To release the plate from the cylinder the process is the converse of that described; one of the mechanisms 7A or 7B is unlocked first (by returning it to the position corresponding to FIG. 6), then the other mechanism is unlocked and then the operations are carried out in the reverse order as compared with mounting.

Over and above the advantages of the invention already explained, it will be noted that a single maneuvering member 19 is sufficient, being used successively on the mechanisms 7A and 7B (or vice versa) and being removed before printing is started.

In accordance with the preferred characteristics of the invention, the supporting abutment 21 is a flat along which the articulation device between the spring link and the rigid link can slide.

In the position holding the plate the spring link 20 tends to stretch, with the articulation to the rigid link 17 sliding on the flat 21; this force is transmitted by the rigid link 17 to the crank 16, in substantially the same direction, which tends to turn the crank (and therefore the bar 4) in the direction which takes up any elongation of the plate (see FIG. 7).

Such compensation is thus obtained automatically, without any manual intervention, as and when any such elongation occurs, which is advantageous as compared with the prior art devices where it was necessary to stop the rotary printing press to retighten the plate, after realising that any such elongation had occurred.

According to other preferred characteristics of the invention, the holding device comprises an abutment 23 for the crank 16, the latter being in the correct position for fitting the plate when it bears on the abutment 23 (see FIG. 5).

This automatic positioning is achieved, which avoids any hit-and-miss insertion of the trailing edge 15 into the slot 5 of the tensioning bar.

According to other preferred characteristics of the invention, the engagement means 18 consist in a transverse bore in the rigid link, the maneuvering member 19 being a lever adapted to be inserted into this bore.

The lever and the bore have simple shapes, are easy to manufacture and convenient to use.

In the embodiment shown, which is particularly simple to manufacture, the lever and the bore are cylindrical, the bore goes right through the link and a shoulder 24 is provided on the lever to limit its insertion into the bore.

The bore and lever are a beneficial arrangement, but it is to be understood that any other known means is within the scope of the invention, for example a flat key and the corresponding prism-shaped engagement means.

The spring link 20 is articulated to the cylinder 2 by a yoke 25 mounted on a flat 26 formed in the cylinder and advantageously machined at the same time as the abutment 21, in the same milling operation, for example.

The yoke 25 comprises a base 27 (see FIG. 8) in which are formed two bores 28A and 28B for screws securing it to the flat 26, two flanks 29A and 29B in which are formed rounded back notches 30A and 30B, and two caps 31A and 31B designed to close off these notches.

The spring link 20 comprises a rod 32 carrying at a first end an articulation yoke 33, this rod being provided with abutments at this first end and at its second end (see below), a slider 34 movable along the rod 32 between said abutments, carrying at least one articualtion journal, in this instance two journals 35A, 35B, and a spring 36 threaded onto the rod 32 between one of said abutments and the slider 34, a washer 37 being provided in this instance between the spring 36 and the slider 34 to secure good contact between them.

In the embodiment shown the yoke 33 carried by the rod 32 at its first end has a surface 38 which forms the abutment provided there; that provided at the second end of the rod is a spring washer or circlip 40 carried by a cylindrical nut 39 which screws onto a thread 41 formed on the rod 32, running from its second end.

The washer 37 comprises a sleeve 43 the outside diameter of which matches the bore 42 formed in the slider 34 and the inside diameter of which matches the diameter of the rod.

If no force is exerted on the spring link 20, the spring urges the annular lateral surface of the sleeve 43 against the nut 39 and the nut and the sleeve 43 can slide within the slider between a position in which the washer 37 comes into contact with the slider 34 and a position in which the ring 40 bears against the slider.

By turning the nut 39 on the thread 41 the position of the abutment 40 along the rod and that of the washer 37 are adjusted, to adjust the unstressed length (with washer 37 against slider 34) and maximum length (abutment 40 against slider 34) of the spring link and the initial compression of the spring 36.

When a compression force is applied to the spring link the rod 32 slides in the slider ( to be more precise in the washer 37) in the direction corresponding to shortening of the link, that is to say the direction in which the abutment 40 moves away from the slider 34. In FIG. 7, for example, in which the link 20 is compressed, the abutment 40 of the nut 39 is seen disengaged from the slider.

The unstressed length of the link 20 is adjusted so that the sum obtained on adding it to the length of the rigid link 17 is greater than the distance between the articulations 53 and 54 when the crank is in a position in which the plate is tensioned on the cylinder, in other words so that the links 17 and 20 are articulated V-fashion when unstressed (see FIG. 6). Of course, this sum must be greater than said distance between the articulations 53 and 54 by a distance sufficient for the link 20 to be compressed when its articulation to the rigid link bears on the abutment 21 (locking would not be obtained if the washer 37 were to bear against the nut 39).

The yoke 33 that the rod 32 carries at its first end is articulated to the rigid link by means of a pivot pin 44 which passes through the bores 45A and 45B in the yoke 33 and a bore 46 in the rigid link. The slider 34 is articulated to the plate cylinder 2 by the yoke 25, the journals 35A and 35B being mounted into the notches 30A and 30B and held in place by the caps 31A and 31B. The rigid link 17 is articulated to the crank 16 by a pivot pin 47 which passes through the bores 48A and 48B in the crank and the bore 49 in the rigid link 17. The crank 16 is provided with a square cross-section bore 50 which fits over a square cross-section boss 51 provided at the end of the shaft 4. The immobilisation of the crank to the shaft is obtained by appropriate known means (not shown) and the same goes for the immobilisation in translation of the pins 44 and 47.

In an alternative embodiment of the invention (not shown) the mechanisms 7A and 7B are placed, not outside the bearing discs 6A and 6B, but between them, in a groove provided in the lateral surface of the cylinder.

The mechanism 7A and 7B are designed to be fitted and operated from above, and therefore without difficulty, in a groove. The arrangement of the mechanism 7A and 7B is in some cases more beneficial than the arrangement shown, especially if it is required to minimise the width of the tensioning bar 4 and to avoid providing bores in the bearing discs 6A and 6B for it to pass through.

It is to be understood that the invention is not limited to the embodiments described and shown, but emcompasses all variations thereon that the man skilled in the art may devise.

I claim:

1. A device for holding a printing plate onto a plate cylinder in a rotary offset printing press, comprising:

(a) a bar for tensioning said plate;

(b) a control mechanism for said bar comprising;

(1) a crank coupled to and rotatable with said tensioning bar between an untensioned position and a tensioned position in which said printing plate is tensioned on said palte cylinder;

(2) a rigid link and a first coupling pivotally connecting said rigid link to said crank;

(3) a spring link and a second coupling pivotally connecting said spring link to said plate cylinder;

(4) a third coupling pivotally connecting together said rigid link and said spring link;

(5) a maneuvering member and engagment means provided on said rigid link for connecting said maneuvering member to said rigid link for maneuvering said control mechanism between an unlocked configuration and a locked configuration;

(6) an abutment for supporting said third coupling in said locked configuration, located so that said spring link passes over a point of maximum compression in maneuvering of the rigid link and spring link between said unlocked configuration to said locked configuration, said spring link being in said point of maximum compression when the longitudinal axes of said spring link and rigid link are generally coplanar, said crank being in a tensioned position.

2. The device of claim 1 wherein said abutment comprises a flat surface along which said third coupling can slide.

3. The device of claim 1 comprising a second abutment providing a stop for said crank, said second abutment correctly positioning said crank in said untensioned position for fitting the printing plate onto the plate cylinder.

4. The device of claim 1 wherein said maneuvering member is a lever, said engagement means being a transverse bore in said rigid link adapted to receive said lever.

5. A device for holding a printing plate onto a plate cylinder on a rotary offset printing press, comprising;

(a) a bar for tensioning said plate;

(b) a control mechanism for said bar comprising;

(1) a crank coupled to and rotatable with said tensioning bar between an untensioned position and a tensioned position in which said printing plate is tensioned on said palte cylinder;

(2) a rigid link and a first coupling pivotally connecting said rigid link to said crank;

(3) a spring link and a second coupling pivotally connecting said spring link to said plate cylinder;

(4) a third coupling pivotally connecting together said rigid link and said spring link;

(5) a maneuvering member and engagement means provided on said rigid link for connecting said maneuvering member to said rigid link for maneuvering said control mechanism between an unlocked configuration and a locked configuration;

(6) an abutment for supporting said third coupling in said locked configuration, located so that said spring link passes over a point of maximum compression in maneuvering of the rigid link and spring link between said unlocked configuration to said locked configuration, said spring link being in said point of maximum compression when the logitudinal axis of said spring link and rigid link are generally coplanar, said crank being in a tensioned position;

(7) wherein said plate cylinder comprises a flat, said second coupling comprising a yoke affixed to said flat and pivotally engaging said spring link.

6. A device for holding a printing plate onto a plate cylinder in a rotary offset printing press, comprising:

(a) a bar for tensioning said plate;

(b) a control mechanism for said bar comprising;

(1) a crank coupled to and rotatable with said tensioning bar between an untensioned position and a tensioned position in which said printing plate is tensioned on said plate cylinder;

(2) a rigid link and a first coupling pivotally connecting said rigid link to said crank;

(3) a spring link and a second coupling pivotally connecting said spring link to said plate cylinder;

(4) a third coupling pivotally connecting together said rigid link and said spring link;

(5) a maneuvering member and engagement means provided on said rigid link for connecting said maneuvering member to said rigid link for maneuvering said control mechanism between an unlocked configuration and a locked configuration;

(6) an abutment for supporting said third coupling in said locked configuration, located so that said spring link passes over a point of maximum compression in maneuvering of the rigid link and spring link between said unlocked configuration to said locked configuration, said spring link being in said point of maximum compression when the longitudinal axis of said spring link and rigid link are generally coplanar, said crank being in a tensioned position;

(7) wherein said spring link comprises:

(i) a threaded rod having opposed first and second ends and carrying at said first end an articulation yoke and comprising opposed stop surfaces adjacent said ends;

(ii) a slider mobile along said rod between said stop surfaces carrying at least one articulation journal; and (iii) a spring threaded onto said rod positioned between one of said stop surfaces and said slider.

7. The device of claim 6 wherein said articulation yoke forms the stop surface adjacent thereto, the other stop surface being adjustably positionable along said rod.

8. The device of claim 6 wherein said articulation yoke is pivotally connected to said rigid link, and said slider is pivotally connected to said plate cylinder.

9. A device for holding a printing plate onto a plate cylinder in a rotary offset printing press, comprising:

(a) a bar for tensioning said plate;

(b) a control mechanism for said bar comprising;

(1) a crank coupled to and rotatable with said tensioning bar between an untensioned position and a tensioned position in which said printing plate is tensioned on said plate cylinder;

(2) a rigid link and a first coupling pivotally connecting said rigid link to said crank;

(3) a spring link and a second coupling pivotally connecting said spring link to said plate cylinder;

(4) a third coupling pivotally connecting together said rigid link and said spring link;

(5) a maneuvering member and engagement means provided on said rigid link for connecting said maneuvering member to said rigid link for maneuvering said control mechanism between an unlocked configuration and a locked configuration;

(6) an abutment for supporting said third coupling in said locked configuration, located so that said spring link passes over a point of maximum compression in maneuvering of the rigid link and spring link between said unlocked configuration to said locked configuration, said spring link being in said point of maximum compression when the longitudinal axis of said spring link and rigid link are generally coplanar, said crank being in a tensioned position;

(7) a cylinder slot formed in the plate cylinder along a generatrix thereof;

(8) a bore provided under the lateral surface of the plate cylinder adjacent said cylinder slot and open to said slot;

(9) said plate tensioning bar being cylindrical and being housed in said bore, said tensioning bar comprising a bar slot formed along a generatrix thereof;

(10) bearing discs at opposite ends of said plate cylinder;

(11) said printing plate comprising folded leading and trailing end portions;

(12) said cylinder slot being adapted to receive said plate leading end portion and said bar slot being adapted to receive said trailing end portion when the printing plate is wound around the plate cylinder between said bearing discs;

(13) said device comprising two tensioning bar control mechanisms at opposite ends of the plate cylinder external to said bearing discs.

10. A device for holding a printing plate onto a plate cylinder in a rotary offset printing press, comprising:

(a) a bar for tensioning said plate;

(b) a control mechanism for said bar comprising;

(1) a crank coupled to and rotatable with said tensioning bar between an untensioned position and a tensioned position in which said printing plate is tensioned on said plate cylinder;

(2) a rigid link and a first coupling pivotally connecting said rigid link to said crank;

(3) a spring link and a second coupling pivotally connecting said spring link to said plate cylinder;

(4) a third coupling pivotally connecting together said rigid link and said spring link;

(5) a maneuvering member and engagement means provided on said rigid link for connecting said maneuvering member to said rigid link for maneuvering said control mechanism between and unlocked configuration and a locked configuration;

(6) an abutment for supporting said third coupling in said locked configuration, located so that said spring link passes over a point of maximum compression in maneuvering of the rigid link and spring link between said unlocked configuration to said locked configuration, said spring link being in said point of maximum compression when the longitudinal axis of said spring link and rigid link are generally coplanar, said crank being in a tensioned position;

(7) a cylinder slot formed in the plate cylinder along a generatrix thereof;

(8) a bore provided under the lateral surface of the plate cylinder adjacent said cylinder slot and open to said slot;

(9) said tensioning bar being cylindrical and being housed in said bore, said tensioning bar comprising a bar slot formed along a generatrix thereof;

(10) bearing discs at opposite ends of said plate cylinder;

(11) said printing plate comprising folded leading and trailing end portions;

(12) said cylinder slot being adapted to receive said plate leading end portion and said bar slot being adapted to receive said trailing end portion when the printing plate is wound around the plate cylinder between said bearing discs;

(13) said device conprising two tensioning bar control mechanisms disposed between the bearing discs in grooves formed in the lateral surface of said plate cylinder.

* * * * *

UNITED STATES PATENT AND TRADEMARK OFFICE

CERTIFICATE OF CORRECTION

PATENT NO. : 4,862,801

DATED : September 5, 1989

INVENTOR(S) : Jean-Claude Marmin

It is certified that error appears in the above-identified patent and that said Letters Patent is hereby corrected as shown below:

Column 7, line 45, change "palte" to --plate--.

Signed and Sealed this

Fourth Day of September, 1990

*Attest:*

HARRY F. MANBECK, JR.

*Attesting Officer*

*Commissioner of Patents and Trademarks*